US006749159B1

(12) United States Patent
Hess

(10) Patent No.: US 6,749,159 B1
(45) Date of Patent: Jun. 15, 2004

(54) STACKABLE WRIST AND ARM SUPPORT PADS

(76) Inventor: Terry Wayne Hess, 802 Torrance Dr., Garland, TX (US) 75040

( * ) Notice: Subject to any disclaimer, the term of this patent is extended or adjusted under 35 U.S.C. 154(b) by 0 days.

(21) Appl. No.: 10/255,726

(22) Filed: Sep. 26, 2002

(51) Int. Cl.[7] ..... A47F 5/00
(52) U.S. Cl. ..... 248/118; 5/657; 5/636
(58) Field of Search ..... 248/118, 118.1, 248/918, 118.3; 400/715; 428/137; 5/657, 655, 633, 636

(56) References Cited

U.S. PATENT DOCUMENTS 4,777,678 A * 10/1988 Moore ..... 5/657
4,802,249 A * 2/1989 Bills ..... 5/420
4,985,952 A * 1/1991 Edelson ..... 5/722
5,058,840 A 10/1991 Moss et al.
5,165,630 A * 11/1992 Connor ..... 248/118.1
5,193,925 A * 3/1993 Foulke ..... 400/715
5,228,655 A * 7/1993 Garcia et al. ..... 248/118
5,342,006 A 8/1994 Tice
5,508,084 A * 4/1996 Reeves et al. ..... 428/172
5,566,913 A * 10/1996 Prokop ..... 248/118
5,697,112 A * 12/1997 Colavito et al. ..... 5/633
5,876,002 A 3/1999 White et al.
5,987,676 A * 11/1999 Littleford et al. ..... 5/636
6,133,556 A 10/2000 Ramsey et al.
6,213,969 B1 4/2001 MacMorran et al.
6,237,879 B1 * 5/2001 Budge ..... 248/118
6,244,547 B1 6/2001 Tonizzo et al.
6,272,704 B1 * 8/2001 Cutler ..... 5/655
6,332,596 B1 12/2001 Su
6,357,703 B1 3/2002 DiOrio

* cited by examiner

*Primary Examiner*—Leslie A. Braun
*Assistant Examiner*—Tan Le
(74) *Attorney, Agent, or Firm*—John D. Gugliotta; Olen L. York, III

(57) ABSTRACT

A stackable wrist and arm support pad assembly is for use while operating a computer. The support pad assembly is adjustable in height by utilizing a series of nesting pads that allow for adjustment to provide the correct ergonomic posture. The base pad is solid in design with a raised padded section. The pads on top of the base pad have a hollow bottom that fits upon the pad of the pad below. In this manner, up to three, four or possibly more pads can be added to provide the correct posture to help avoid stress on the wrist, elbow and shoulder of the user. The pads may include a removable and washable cover. Additionally, the pads are available in different sizes and shapes to fit all types of keyboards and mouse pads. The use of the stackable wrist and arm support pad assembly provides not only wrist support for users of any computer system, but also provides correct ergonomic posture for all users regardless of desk, chair, keyboard or mouse placement as well, which may help reduce the severity of repetitive stress injuries.

18 Claims, 4 Drawing Sheets

STACKABLE WRIST AND ARM SUPPORT PADS

RELATED APPLICATIONS

The present invention was first described in Disclosure Document Registration No. 510,460 filed on Apr. 23, 2002 under 35 U.S.C. §122 and 37 C.F.R. §1.14. There are no previously filed, nor currently any co-pending applications, anywhere in the world.

BACKGROUND OF THE INVENTION

1. Field of the Invention

The present invention relates generally to support pads, and more specifically to a stackable apparatus for supporting the arms and wrists of a person while using a computer.

2. Description of the Related Art

The computer revolution has affected virtually every aspect of our lives. It is in the not-too-distant future that one could envision the personal computer as a necessary appliance in every household. In fact, a large percentage of American households own at least one personal computer. As these numbers continue to increase, the market for computer accessories that enhance the usability of computers is growing as well. Perhaps the most well known of these accessories is the wrist support used on keyboards and more recently computer mice. These devices help hold the wrist at a proper angle thus reducing stress-induced injuries, such as carpal tunnel syndrome. While wrist supports do an admirable job, many people find them lacking due to the fact that they are not adjustable. After all, desk chairs, keyboards, monitors and the like are adjustable to suit various size users, but wrist supports are designed in a "one size fits all" manner. Accordingly, a need has developed for a device that addresses these shortcomings and provides ergonomic comfort for computer users.

A search of the prior art did not disclose any patents that read directly on the claims of the instant invention; however, the following references were considered related:

U.S. Pat. No. 6,357,703, issued in the name of DiOrio, describes a computer mouse support and lower arm rest;

U.S. Pat. No. 6,332,596, issued in the name of Su, describes a device for mounting wrist support to keyboard;

U.S. Pat. No. 6,244,547, issued in the name of Tonizzo et al., describes a keyboard support tray for supporting user's palm or wrist;

U.S. Pat. No. 6,213,969, issued in the name of MacMorran et al., describes a wrist splint;

U.S. Pat. No. 6,133,556, issued in the name of Ramsey et al., describes a heated deformable support for use with keyboard or mouse;

U.S. Pat. No. 5,876,002, issued in the name of White et al., describes an arm support mechanism;

U.S. Pat. No. 5,342,006, issued in the name of Tice, describes a desk fittable arm rest; and U.S. Pat. No. 5,058,840, issued in the name of Moss et al., describes an arm rest assembly for use with keyboard or mouse pad.

Consequently, there exists a need for new product ideas and enhancements for existing products in the computer accessories industry directed at a stackable wrist and arm support.

SUMMARY OF THE INVENTION

It is therefore an object of the present invention to provide a stackable wrist and arm support pad for use during computer operation by a user.

It is a feature of the present invention to provide a support pad having a cushioned support pad for providing rigid, yet comfortable, support to a user's wrist or arms.

It is a further feature of the present invention to provide a support pad having a hollow interior for allowing stacking of a plurality of support pads.

It is a further feature of the present invention to provide a support pad having a plurality of keys and corresponding key notches, thereby preventing slippage of the stacked support pads.

Briefly described according to one embodiment of the present invention, the stackable wrist and arm support pad is a stackable wrist and arm support pad for use while operating a computer. The pad is adjustable in height by utilizing a series of nesting pads that allow for adjustment to provide the correct ergonomic posture. The base pad is solid in design with a raised padded section. The pads on top of the base pad have a hollow bottom that fits upon the pad of the pad below. In this manner, up to three, four or possibly more pads can be added to provide the correct posture to help avoid stress on the wrist, elbow and shoulder of the user. The pads may include a removable and washable cover. Additionally, the pads are available in different sizes and shapes to fit all types of keyboards and mouse pads. The use of the stackable wrist and arm support pad provides not only wrist support for users of any computer system, but also provides correct ergonomic posture for all users regardless of desk, chair, keyboard or mouse placement as well, which may help reduce the severity of repetitive stress injuries.

The use of the present invention provides users with all of the materials and tools necessary to ensure that a user may easily use and maintain a stackable support pad for the wrists and arms of a computer operator.

An advantage of the present invention is that it is specifically adapted for personal use because of the light weight components and the use of inexpensive materials.

A further advantage of the present invention is that it is specifically adapted for ease of stacking, thereby allowing a user to adjust the height of the apparatus as necessary.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
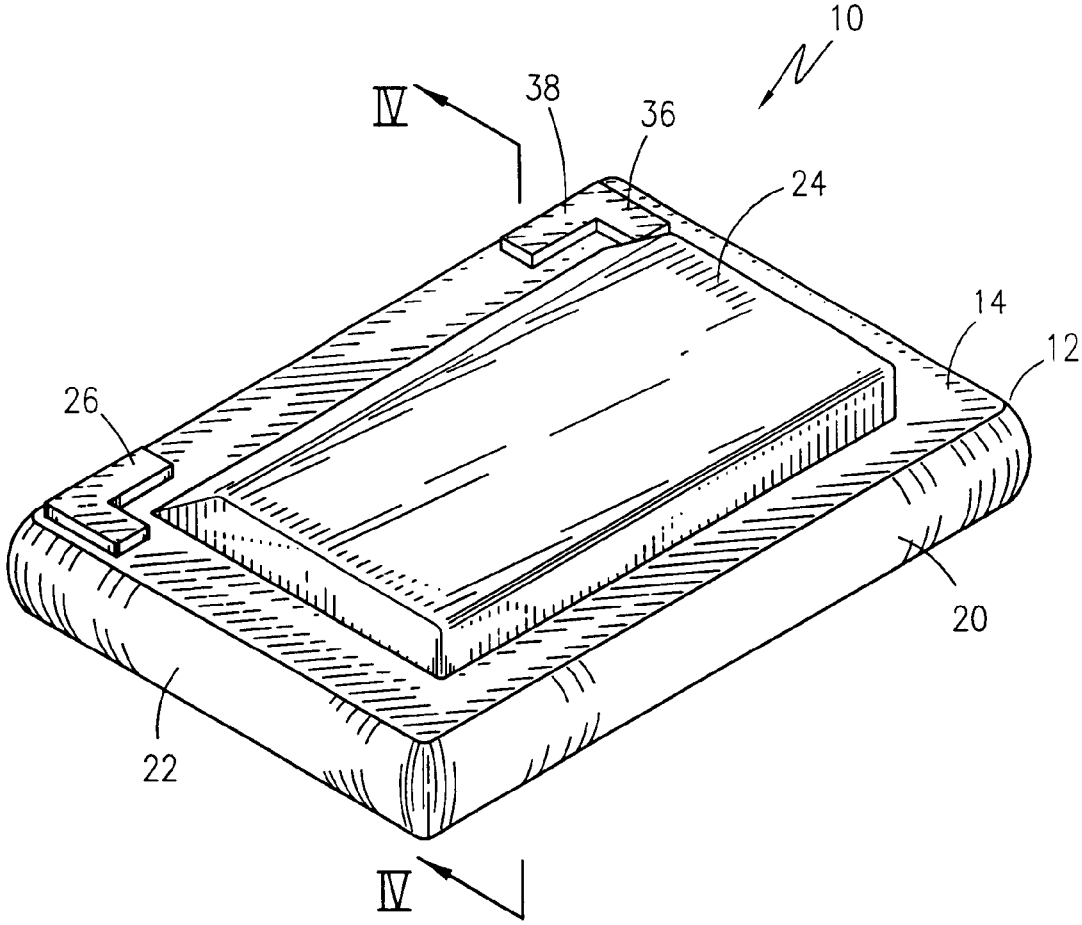
FIG. 1 is a perspective view of a stackable wrist and arm support pad.
Figure 2:
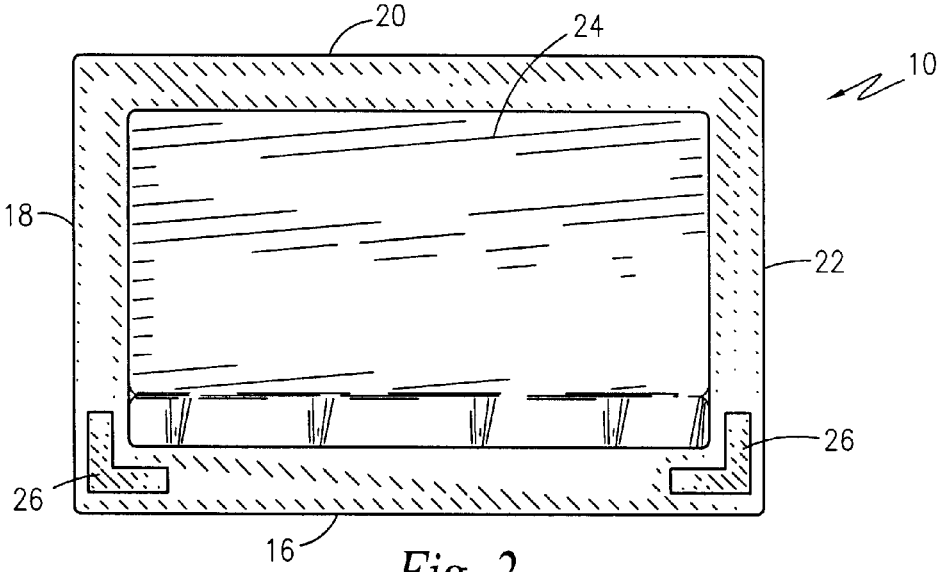
FIG. 2 is a top view of the apparatus of FIG. 1, illustrating the arrangement of the pad on the support base and the keys arranged along the outer perimeter.
Figure 3:
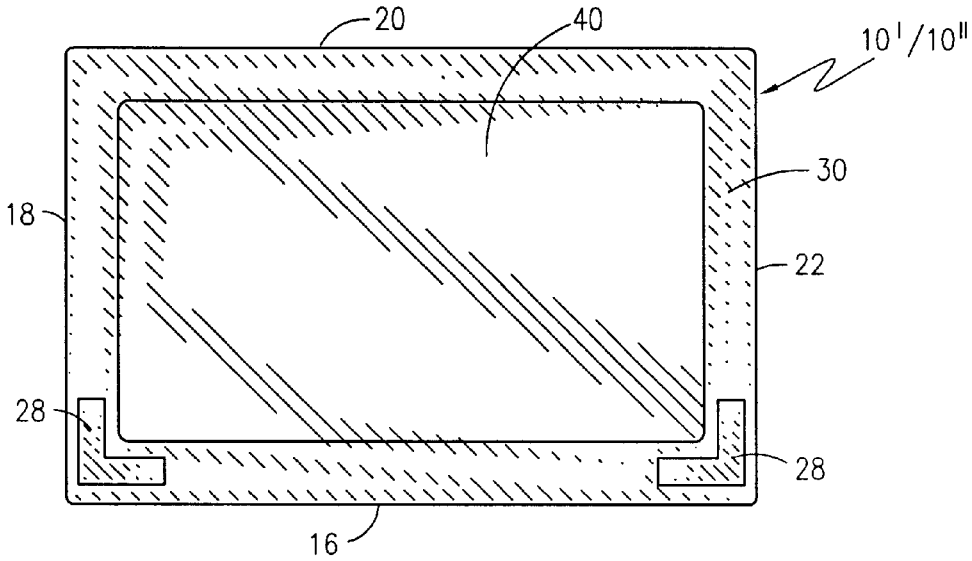
FIG. 3 is a bottom view of the apparatus of FIG. 1, illustrating the hollow interior formed by the planar top and the sidewalls, and also illustrating the key notches formed for receiving the keys.
Figure 4:
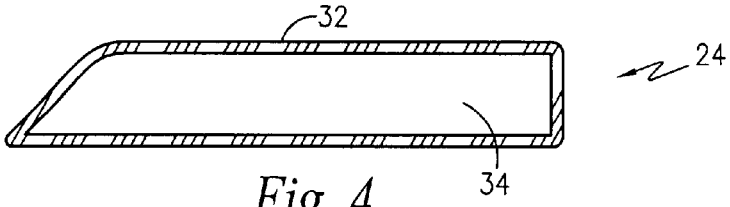
FIG. 4 is a cross-sectional view of the padding used on the support pad, taken through line IV—IV.

Referring now to FIG. 1 through FIG. 3, a stackable wrist and arm support pad assembly is shown in accordance with the preferred embodiment of the present invention and is generally denoted as 10, but may also include a second pad 10' and a third pad 10" as part of the assembly. A first support pad 10 includes a support base 12 having a planar top 14 depending from four sidewalls 16, 18, 20, and 22. A padding 24 is affixed to the planar top 14 to provide wrist and/or arm support to a user. Along the perimeter of the planar top 14 is a plurality of keys 26 that are inserted into corresponding key notches 28.

Figure 6:
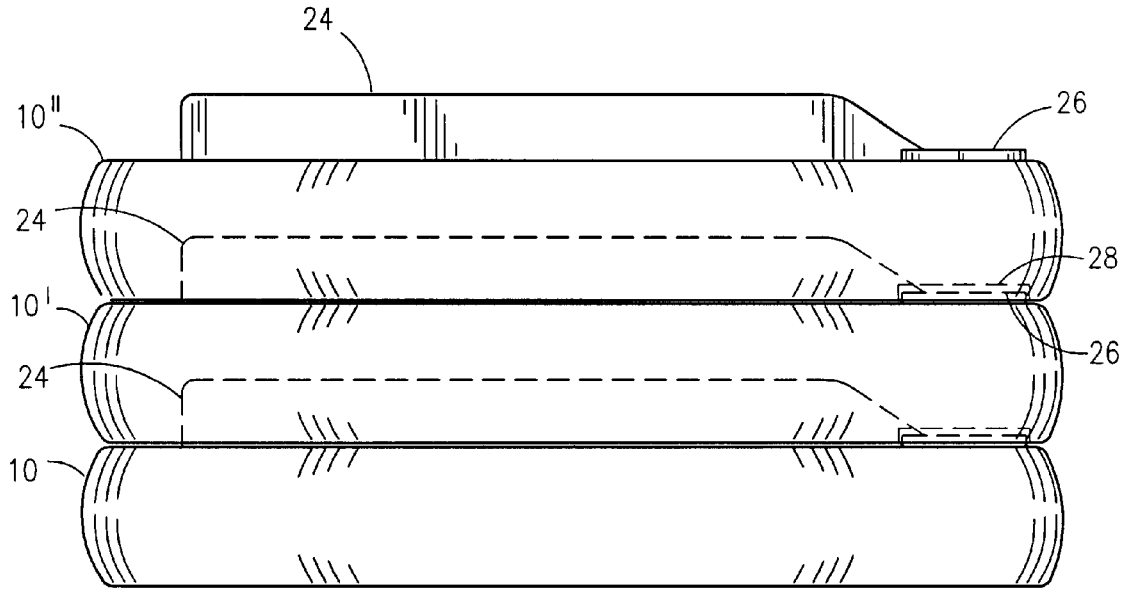
FIG. 6 is a side view of a plurality of stackable support pads shown in a stacked arrangement, wherein the phantom lines indicate the relative positioning of the keys within the key notches and the padding within the hollow interior.

The support base 12 forms a general rectangular perimeter in which a planar top 14 lies parallel to a desk surface. The four sidewalls 16,18, 20, and 22 perpendicularly depend from the planar top 14, extending downward from the planar top 14. The four sidewalls 16, 18, 20, and 22 also perpendicularly depend from one another, wherein a first sidewall 16 is coupled to a second sidewall 18 and forming a right angle therefrom. The second sidewall 18 is coupled to a third sidewall 20 forming a right angle therefrom. The third sidewall 20 is coupled to a fourth sidewall 22 forming a right angle therefrom. The fourth sidewall 22 is coupled to the first sidewall 16 forming a right angle therefrom. The consecutive right angle (or perpendicular) coupling of the four sidewalls 16, 18, 20, and 22 forms a general rectangular outer perimeter of the support base 12. For pad 10, the planar top 14 is opposed by a solid planar bottom 42 (as best shown in FIG. 6), wherein the top 14 and the bottom 42 depend from the four sidewalls 16,18, 20 and 22. For pads 10' and 10", the planar top 14 and the depending four sidewalls 16,18, 20 and 22 form a hollow interior 40 underneath the pad 10, which permits one of the support pads 10' or 10" to be stacked on top of another support pad 10' or 10". The hollow interior 40 includes a plurality of key notches 28 for receiving a plurality of keys 26.

Referring now to FIG. 1 through FIG. 4, the padding 24 is affixed to the planar top 14 so as to provide rigid but comfortable support to a user's wrists and/or arms when using a computer keyboard or mouse. The padding 24 includes a outer layer 32 and an inner layer 34. The outer layer 32 is a covering manufactured from a soft and pliable material, such as cloth, nylon, vinyl, canvass, felt or other similar materials. The outer layer 32 covers the inner layer 34. The inner layer 34 is the space formed by the outer layer 32, and the inner layer 34 may be filled with air, gel, foam, beads, buckwheat husks or other cushioning material so as to provide rigid support to a user's wrist or arms while also providing a comfortable feel.

Figure 5:
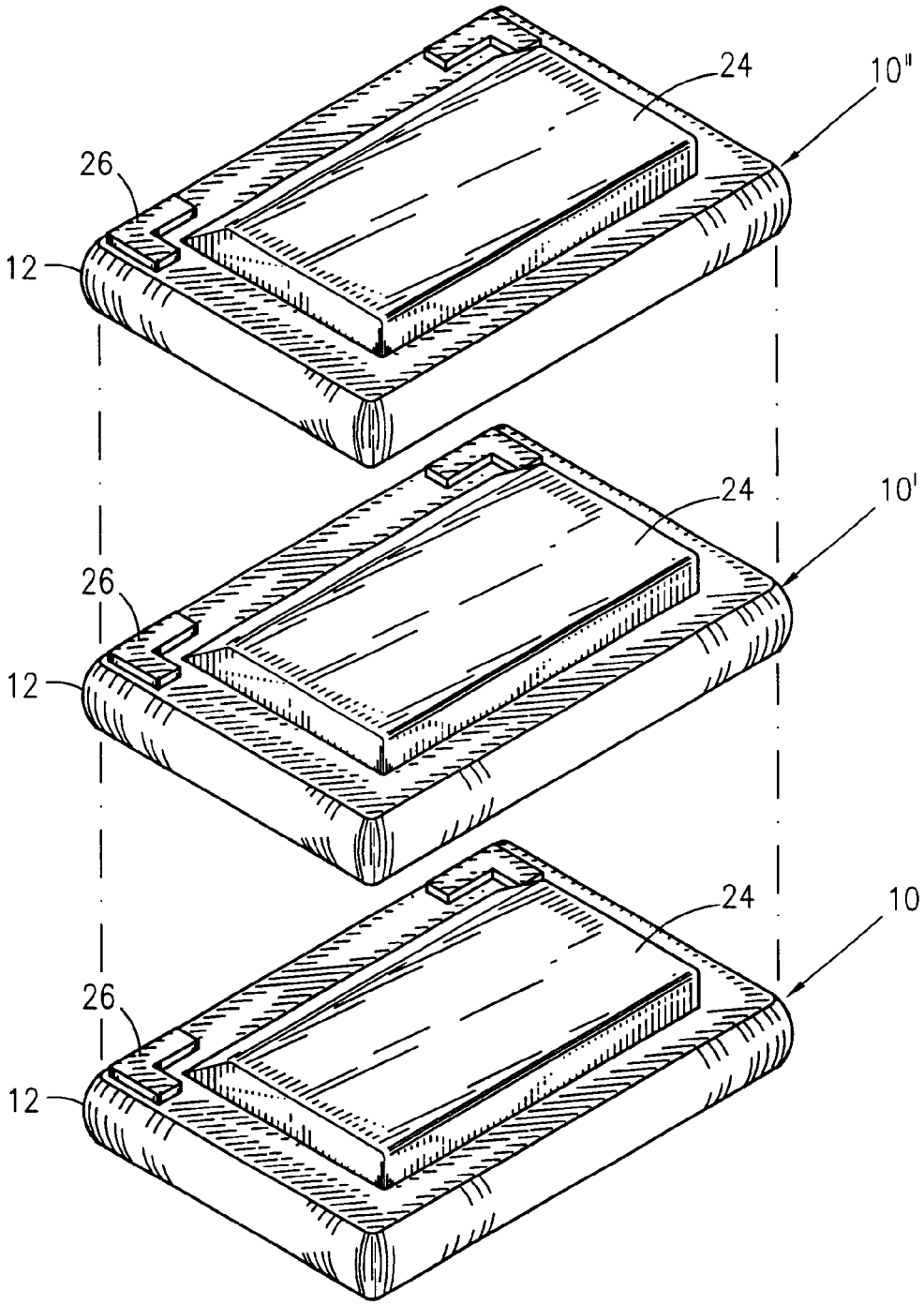
FIG. 5 is an exploded perspective of a plurality of stackable support pads shown in an unattached arrangement and with lines indicated the coupling points of the apparatus.

A plurality of keys 26 are positioned along the outer perimeter of the support base 12 and along the planar top 14. The keys 26 may be of various shapes and configurations. For purposes of illustration, and not by way of limitation to the scope of the invention, the keys 26 shown in FIG. 1 and FIG. 5 have an "L" shape, wherein a first member 36 and a second member 38 are coupled at a corner to form an "L" shape. The keys 26 correspond to a plurality of key notches 28, wherein the key notches 28 are formed in a lip 30 of the support base 12 and adjacent to the hollow interior 40. The hollow interior 40 receives the padding 24 and planar top 14 of the support base 12, wherein the key notches 28 are aligned with the keys 26 so that the keys 26 slide into and within the key notches 28. The key notches 28 hold the adjacent support pad 10 in place and provide a means for adjusting the height of the support pads 10.

It is envisioned that other styles and configurations of the present invention can be easily incorporated into the teachings of the present invention, and only one particular configuration shall be shown and described for purposes of clarity and disclosure and not by way of limitation of the scope.

2. Operation-of the Preferred Embodiment

Stackable wrist and arm support pads 10, 10' or 10" may be sold individually or as an assembly. To use a single stackable wrist and arm support pad 10, a user will position the support pad 10 so that the support pad 10 lies along the same linear path as the arms and wrists when positioned in front of a keyboard or a computer mouse. The padding 24 of the support pad 10 provides a cushioned support to the wrist and arms, thereby reducing fatigue and further reducing stress induced injuries associated with keyboard or computer mouse use, such as carpel tunnel syndrome.

To adjust the height of the support pads 10, a user will simply align a second support pad 10' over the first support pad 10 so that the keys 26 of the first support pad 10 will slide into the key notches 28 of the second support pad 10'. The key notches 28 securely hold the keys 26 of the adjacent first support pad 10 and prevent slippage and sliding of the support pads 10 and 10'. The stacking of the support pads 10 and 10' provide an upward height adjustment suitable to the needs of the user. If desired, a third support pad 10" may be added in the same manner as the second support pad 10', thus further adjusting the height upward.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

What is claimed is:

1. A stackable wrist and arm support pad assembly comprising:

a first support pad comprising a planar top opposing a bottom, said top and bottom depending from four sidewalls said ton comprising a cushioned pad, and said top comprising a plurality of keys upwardly projecting therefrom; and a second support pad comprising a top opposing a bottom and forming a hollow underside for nestably receiving said first support pad, said top comprising a cushioned pad, said hollow underside comprising a plurality of key notches, wherein each one of said plurality of key notches receives a respective one of said plurality of keys, said plurality of key notches and said plurality of keys cooperating to prevent lateral and longitudinal movement between said first support pad and said second support pad.

2. The support pad assembly of claim 1, wherein said cushioned pad of said first support pad or said second support pad comprises an outer layer and an inner layer.

3. The support pad assembly of claim 2, wherein said outer layer is material enveloping said inner layer, said outer layer manufactured from soft material.

4. The support pad assembly of claim 3, wherein said soft material is selected from the group consisting of cloth, nylon, vinyl, canvass or felt.

5. The support pad assembly of claim 2, wherein said inner layer is a space formed by said outer layer, said inner layer filled with cushioning material.

6. The support pad assembly of claim 5, wherein said cushioning material is air, gel, foam, beads or buckwheat husks.

7. The support pad assembly of claim 1, wherein said plurality of keys may have a variety of geometric shapes.

8. The support pad assembly of claim 7, wherein said geometric shape is "L" shaped.

9. The support pad assembly of claim 8, wherein said "L" shaped key comprises a first member coupled to a second member.

10. The support pad assembly of claim 1, wherein said second support pad, further comprises a plurality of keys upwardly protecting therefrom;

a third support pad comprising a top opposing a bottom and forming a hollow underside for nestably receiving said second support pad, said top comprising a cushioned pad, said hollow underside comprising a plurality of key notches, wherein each one of said plurality of key notches receives a respective one of said plurality of keys, said plurality of key notches and said plurality of keys cooperating to prevent lateral and longitudinal movement between said second support pad and said third support pad.

11. The support pad assembly of claim 10, wherein said cushioned pad of said first support pad or said second support pad or said third support pad comprises an outer layer and an inner layer.

12. The support pad assembly of claim 11, wherein said outer layer is material enveloping said inner layer, said outer layer manufactured from soft material.

13. The support pad assembly of claim 12, wherein said soft material is selected from the group consisting of cloth, nylon, vinyl, canvass or felt.

14. The support pad assembly of claim 11, wherein said inner layer is a space formed by said outer layer, said inner layer filled with cushioning material.

15. The support pad assembly of claim 14, wherein said cushioning material is air, gel, foam, beads or buckwheat husks.

16. The support pad assembly of claim 10, wherein said plurality of keys may have a variety of geometric shapes.

17. The support pad assembly of claim 16, wherein said geometric shape is "L" shaped.

18. The support pad assembly of claim 17, wherein said "L" shaped key comprises a first member coupled to a second member.

* * * * *